US010443214B2

(12) United States Patent
Shimano et al.

(10) Patent No.: US 10,443,214 B2
(45) **Date of Patent: *Oct. 15, 2019**

(54) CONTROL SYSTEM FOR WORK VEHICLE, CONTROL METHOD, AND WORK VEHICLE

(71) Applicant: KOMATSU LTD., Tokyo (JP)

(72) Inventors: Yuki Shimano, Suita (JP); Jin Kitajima, Ohiso-machi (JP); Yoshiki Kami, Hadano (JP); Masashi Ichihara, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 127 days.

This patent is subject to a terminal disclaimer.

(21) Appl. No.: 15/704,400

(22) Filed: Sep. 14, 2017

(65) Prior Publication Data

US 2018/0002901 A1 Jan. 4, 2018

Related U.S. Application Data

(63) Continuation of application No. 15/118,321, filed as application No. PCT/JP2016/058574 on Mar. 17, 2016, now Pat. No. 9,803,340.

(51) Int. Cl.
*E02F 9/26* (2006.01)
*E02F 3/43* (2006.01)
(Continued)

(52) U.S. Cl.
CPC ..... *E02F 9/262* (2013.01); *E02F 3/32* (2013.01); *E02F 3/435* (2013.01); *E02F 9/2025* (2013.01);
(Continued)

(58) Field of Classification Search
CPC . E02F 9/262; E02F 9/2025; E02F 3/32; E02F 9/265; E02F 3/435; E02F 9/2296; E02F 9/2292
See application file for complete search history.

(56) References Cited

U.S. PATENT DOCUMENTS

2005/0177292 A1 8/2005 Okamura et al.
2011/0318155 A1 12/2011 Okamura et al.
(Continued)

FOREIGN PATENT DOCUMENTS

CN 1655076 A 8/2005
CN 102341547 A 2/2012
(Continued)

OTHER PUBLICATIONS

The Office Action for the corresponding Chinese application No. 201680000615.1, dated Dec. 22, 2016.
(Continued)

*Primary Examiner* — Rodney A Butler
(74) *Attorney, Agent, or Firm* — Global IP Counselors, LLP

(57) ABSTRACT

A control system for a work vehicle includes at least one sensor, an operating device, and a controller. The operating device includes at least one operating member. The controller is programmed to control a work implement of the work vehicle based on signals from the at least one sensor and the operating device. The controller is further programmed to use the signals to obtain a distance between the work implement and a design terrain which represents a target shape of a work object, and to determine whether a surface compaction determination condition indicating that work performed by the work implement is surface compaction work is satisfied. The controller executes a surface compaction control in which a velocity of the work implement toward the design terrain is limited in response to the distance between the work implement and the design terrain when the surface compaction determination condition is satisfied.

15 Claims, 14 Drawing Sheets

(51) Int. Cl.

| | |
|---|---|
| ***E02F 9/22*** | (2006.01) |
| ***E02F 3/32*** | (2006.01) |
| ***E02F 9/20*** | (2006.01) |

(52) U.S. Cl.
CPC ..... *E02F 9/2292* (2013.01); *E02F 9/2296* (2013.01); *E02F 9/265* (2013.01)

(56) References Cited

U.S. PATENT DOCUMENTS

| | | | |
|---|---|---|---|
| 2016/0010312 | A1 | 1/2016 | Kurihara et al. |
| 2016/0040398 | A1 | 2/2016 | Kitajima et al. |
| 2017/0183845 | A1 | 6/2017 | Izumikawa |

FOREIGN PATENT DOCUMENTS

| | | | |
|---|---|---|---|
| CN | 104781478 | A | 7/2015 |
| EP | 1 243 864 | A2 | 9/2002 |
| JP | 10-37230 | A | 2/1998 |
| JP | 2007-85093 | A | 4/2007 |
| JP | 2007-113304 | A | 5/2007 |
| JP | 2010-121441 | A | 6/2010 |
| JP | 2010-209523 | A | 9/2010 |
| JP | 5595618 | B1 | 9/2014 |

OTHER PUBLICATIONS

The International Search Report for the corresponding international application No. PCT/JP2016/058574, dated May 24, 2016.

CONTROL SYSTEM FOR WORK VEHICLE, CONTROL METHOD, AND WORK VEHICLE

CROSS-REFERENCE TO RELATED APPLICATIONS

This application is a continuation of U.S. patent application Ser. No. 15/118,321, which is a U.S. National stage application of International Application No. PCT/JP2016/058574, filed on Mar. 17, 2016. The entire disclosures of U.S. patent application Ser. No. 15/118,321 and International Application No. PCT/JP2016/058574 are hereby incorporated herein by reference.

BACKGROUND

Field of the Invention

The present invention relates to a control system for a work vehicle, a control method, and a work vehicle.

Background Information

Conventionally, a control (referred to below as "leveling control") for causing a work implement to move along a design terrain has been carried out in a control system of a work vehicle. The design terrain is a surface that indicates a target shape to be excavated.

For example, the boom in the hydraulic excavator in Japanese Patent Publication No. 5595618 is automatically raised when the cutting edge of the bucket is about to be lowered further than the design terrain. Accordingly, the cutting edge of the bucket can be moved along the design terrain and leveling work can be carried out favorably.

SUMMARY

In order to automatically start the above-mentioned leveling control, there is a need to precisely detect that the work vehicle is attempting to perform the leveling work. As a result, the execution of the leveling control can be determined, for example, by determining whether an operation to move the work implement along the ground surface is being performed.

However, a work vehicle may perform surface compaction work on the ground surface to be leveled in addition to the above-mentioned leveling work. Surface compaction work involves moving the work implement toward the ground surface and striking the ground surface whereby the ground surface becomes compacted.

It was considered to carry out a control (referred to below as "surface compaction control") for automatically limiting the velocity of the work implement toward the design terrain in response to the distance between the work implement and the design terrain when the work performed by the work implement is determined as being the surface compaction work. According to the surface compaction control, the work implement is able to strike the ground surface and solidly compact the ground surface.

However, in order to change the position for surface compaction during the surface compaction work, an operation such, as moving the work implement along the ground surface, may be carried out. This type of operation is similar to the above-mentioned operation for determining the execution of the leveling control. As a result, there is a concern that the leveling control may be executed even though the surface compaction work is being carried out. In this case, the work implement is controlled according to a behavior that differs from the surface compaction control and the operator may feel a sense of discomfort.

An object of the present invention is to provide a control system for a work vehicle, a control method, and a work vehicle that allow for favorable leveling work and surface compaction work.

A control system for a work vehicle according to a first aspect of the present invention is provided with at least one sensor, an operating device including at least one operating member, and a controller including a memory and a processor. The controller is operatively connected to receive signals from the at least one sensor and the operating device. The controller is programmed to control the work implement based on the signals. The controller is programmed to obtain a distance between the work implement and a design terrain which represents a target shape of a work object based on the signals. The controller is programmed to determine whether a surface compaction determination condition indicating that work performed by the work implement is surface compaction work is satisfied based on the signals. The controller is programmed to execute a surface compaction control in which a velocity of the work implement toward the design terrain is limited in response to the distance between the work implement and the design terrain when the surface compaction determination condition is satisfied.

In the control system of the work vehicle according to the present aspect, the controller determines whether the surface compaction determination condition is satisfied based on the signals from the sensor and the operating device. The surface compaction determination condition indicating that work performed by the work implement is surface compaction work. Thus, the controller determines whether surface compaction work is being performed based on the signals. When surface compaction work is being performed, the controller executes the surface compaction control to limit the velocity of the work implement toward the design terrain in response to the distance between the work implement and the design terrain. In this way, the controller automatically limits the velocity of the work implement toward the design terrain when surface compaction work is being performed.

The work implement may include a boom, an arm attached to a tip of the boom, and a work tool attached to a tip of the arm, and the surface compaction determination condition may include an operation of the boom. In this way, the controller can readily determine if the surface compaction work is being performed based on an operation of the boom. As a result, the surface compaction work can be carried out in a favorable manner.

The at least one sensor may include at least one of a stroke sensor of the boom, a stroke sensor of the arm, a stroke sensor of the work tool, a tilt angle sensor of the work vehicle, and a three-dimensional position sensor. Thus, the position of the work implement with respect to the design terrain can be determined using signals from one or more of these sensors.

The controller may be programmed to determine whether a leveling determination condition indicating that work performed by the work implement is leveling work is satisfied based on the signals, and to execute a leveling control in which the work implement is controlled such that the work implement moves along the design terrain when the leveling determination condition is satisfied. In this way, the controller executes the leveling control when the leveling determination condition is satisfied, and the controller executes a surface compaction control when the surface compaction determination condition is satisfied. Thus, the leveling work can be carried out in a favorable manner, and the surface compaction work can be carried out in a favorable manner.

The controller may be programmed to cancel the leveling control when the surface compaction determination condition is satisfied while the leveling control is being executed. In this way, the leveling control is canceled smoothly when, for example, the operator attempts to carry out surface compaction after leveling the ground surface. As a result, the surface compaction work can be carried out in a favorable manner.

The controller may cancel the leveling control and execute the surface compaction control when the surface compaction determination condition is satisfied while the leveling control is being executed. In this way, the control can be switched smoothly from the leveling control to the surface compaction control when the operator attempts to carry out surface compaction after leveling the ground surface. As a result, the surface compaction work can be carried out in a favorable manner.

The work implement may include a boom, an arm attached to a tip of the boom, and a work tool attached to a tip of the arm, and the leveling determination condition may include an operation of the arm. In this way, the controller can readily determine if the leveling work is being performed based on an operation of the arm. As a result, the leveling work can be carried out in a favorable manner.

The controller may be programmed to maintain the surface compaction control when the leveling determination condition is satisfied while the surface compaction control is being executed. Because the surface compaction work is maintained even when the leveling determination condition is satisfied while the surface compaction control is being executed, a case of the leveling control being executed by mistake during the surface compaction work can be suppressed even if it is difficult to differentiate between the leveling work and the surface compaction work from the operation contents of the operating member.

The surface compaction determination condition may include a first surface compaction condition and a second surface compaction condition. The controller may start the surface compaction control when the first surface compaction condition is satisfied. The controller may switch to the leveling control when the leveling determination condition is satisfied while the first surface compaction condition is satisfied and the second surface compaction condition is not satisfied The control deciding unit may maintain the surface compaction control when the leveling determination condition is satisfied while the second surface compaction condition is satisfied, the second surface compaction condition having been satisfied following a state in which the first surface compaction condition was satisfied.

In this way, the surface compaction control can be started promptly by starting the surface compaction control when the first surface compaction condition is satisfied. Moreover, the control may be switched to the leveling control when the leveling determination condition is satisfied while the first surface compaction condition is satisfied. As a result, leveling work can be carried out favorably due to the leveling control when an operation to level the ground surface is carried out immediately after carrying out the surface compaction. Furthermore, the surface compaction control may be maintained when the leveling determination condition is satisfied while the second surface compaction condition is satisfied following the first surface compaction condition. As a result, a case of the control being switched mistakenly to the leveling control can be suppressed when the surface compaction work is repeated.

The first surface compaction condition may include an operation of the boom in a predetermined direction. The second surface compaction condition may include an operation of the boom in a direction reverse to the predetermined direction. In this way, a determination can be made easily whether a leveling operation of the ground surface is being carried out immediately after carrying out surface compaction, or when the operation of the surface compaction is being repeated.

A control system for a work vehicle according to a second aspect of the present invention is provided at least one sensor; an operating device including at least one operating member, and a controller including a memory and a processor. The operating device is configured to generate at least one operation signal in response to an operation of the at least one operating member. The controller is operatively connected to receive at least one detection signal from the at least one sensor and to receive the at least one operation signal from the operating device. The controller is programmed to control the work implement based on the at least one operation signal. The controller is programmed to use the at least one detection signal to obtain a distance between the work implement and a design terrain which represents a target shape of a work object. The controller is programmed to use the at least one operation signal to determine whether a leveling determination condition indicating that work performed by the work implement is leveling work is satisfied, and to determine whether a surface compaction determination condition indicating that work performed by the work implement is surface compaction work is satisfied, the surface compaction determination condition including a first surface compaction condition and a second surface compaction condition. The controller is programmed to determine whether to execute a leveling control in which the work implement is controlled so that the work implement moves along the design terrain, or to execute a surface compaction control in which the velocity of the work implement towards the design terrain is limited in response to the distance between the work implement and the design terrain. The controller is programmed to start the surface compaction control when the first surface compaction condition is satisfied. The controller is programmed to switch to the leveling control when the leveling determination condition is satisfied while the first surface compaction condition is satisfied and the second surface compaction condition is not satisfied. The controller is programmed to maintain the surface compaction control when the leveling determination condition is satisfied while the second surface compaction condition is satisfied, the second surface compaction condition having been satisfied following a state in which the first surface compaction condition was satisfied.

In the control system of the work vehicle according to this aspect, the surface compaction control can be started promptly by starting the surface compaction control when the first surface compaction condition is satisfied. Moreover, the control may be switched to the leveling control when the leveling determination condition is satisfied while only the first surface compaction condition is satisfied. As a result, leveling work can be carried out favorably due to the leveling control when an operation to level the ground surface is carried out immediately after carrying out the surface compaction. Furthermore, the surface compaction control is maintained when the leveling determination condition is satisfied while the second surface compaction condition is satisfied following the first surface compaction condition. As a result, a case of the control being switched mistakenly to the leveling control can be suppressed when the surface compaction work is repeated.

A control method for a work vehicle according to a third aspect of the present invention is for a work vehicle that includes a work implement, at least one sensor, an operating device, and a controller programmed to control the work implement based on signals from the at least one sensor and the operating device. The method includes the following steps: obtaining a distance between the work implement and a design terrain which represents a target shape of a work object based on the signals; determining whether a leveling determination condition indicating that the work performed by the work implement is leveling work is satisfied based on the signals; determining whether a surface compaction determination condition indicating that the work performed by the work implement is surface compaction work is satisfied based on the signals; executing a leveling control in which the work implement is controlled such that the work implement moves along the design terrain when the leveling determination condition is satisfied; executing a surface compaction control in which the velocity of the work implement toward the design terrain is limited in response to the distance between the work implement and the design terrain when the surface compaction determination condition is satisfied; and maintaining the surface compaction control when the leveling determination condition is satisfied while the surface compaction control is being executed.

In the control method of the work vehicle according to this aspect, the leveling control is executed when the leveling determination condition is satisfied. As a result, the leveling work can be carried out in a favorable manner. The surface compaction control is carried out when the surface compaction determination condition is satisfied. As a result, the surface compaction work can be carried out in a favorable manner. Moreover, the surface compaction work is maintained even when the leveling control condition is satisfied while the surface compaction control is being carried out. As a result, a case of the leveling control being carried out mistakenly during the surface compaction work can be suppressed. As a result, the leveling work and the surface compaction work can be carried out in a favorable manner.

A work vehicle according to a fourth aspect of the present invention is equipped with a work implement and a controller. The controller includes a memory and a processor. The controller is programmed to execute a leveling control in which work implement is controlled such that the work implement moves along a design terrain indicating a target shape of a work object when a leveling determination condition is satisfied, the leveling determination condition indicating that the work performed by the work implement is leveling work. The controller is programmed to execute a surface compaction control in which the work implement is controlled such that a velocity of the work implement toward the design terrain is limited in response to a distance between the work implement and the design terrain when a surface compaction determination condition is satisfied, the surface compaction determination condition indicating that the work performed by the work implement is surface compaction work. The controller is configured to maintain the surface compaction control when the leveling determination condition is satisfied while the surface compaction control is being executed.

In the work vehicle according to this aspect, the leveling control is executed when the leveling determination condition is satisfied. As a result, the leveling work can be carried out in a favorable manner. The surface compaction control is carried out when the surface compaction determination condition is satisfied. As a result, the surface compaction work can be carried out in a favorable manner. Moreover, the surface compaction work is maintained even if the leveling control condition is satisfied while the surface compaction control is being carried out. As a result, a case of the leveling control being carried out mistakenly during the surface compaction work can be suppressed. As a result, the leveling work and the surface compaction work can be carried out in a favorable manner.

According to the present invention, leveling work and surface compaction work can be carried out favorably by the work vehicle.

DESCRIPTION OF EXEMPLARY EMBODIMENTS

Figure 1:
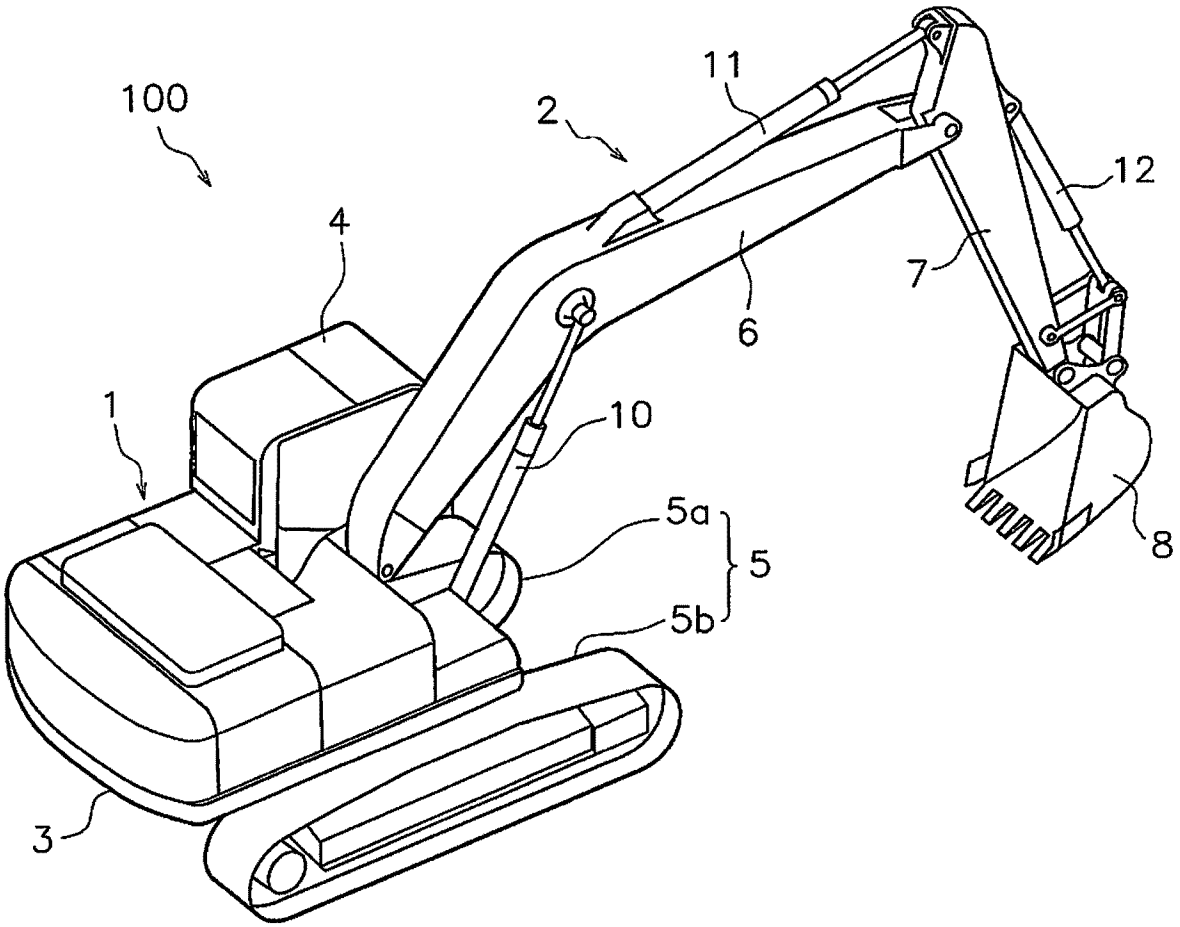
FIG. 1 is a perspective view of a work vehicle according to an exemplary embodiment.

Herein, exemplary embodiments of the present invention will be described with reference to the drawings. FIG. 1 is a perspective view of a work vehicle 100 according to an exemplary embodiment. The work vehicle 100 is a hydraulic excavator according to the present exemplary embodiment. The work vehicle 100 is provided with a vehicle body 1 and a work implement 2.

The vehicle body 1 has a revolving body 3 and a travel device 5. The revolving body 3 contains devices such as an engine and a hydraulic pump described below. An operating cabin 4 is provided in the revolving body 3. The travel device 5 has crawler belts 5*a* and 5*b*, and the work vehicle 100 travels due to the rotation of the crawler belts 5*a* and 5*b*.

The working equipment 2 is attached to the vehicle body 1. The work implement 2 has a boom 6, an arm 7, and a bucket 8. The base end portion of the boom 6 is attached in an operable manner to the front portion of the vehicle body 1. The base end portion of the arm 7 is attached in an operable manner to the tip portion of the boom 6. The bucket 8 is attached in an operable manner to the tip portion of the arm 7.

The bucket 8 is an example of a work tool. A work tool other than the bucket 8 may be attached to the tip portion of the arm 7.

The work implement 2 includes a boom cylinder 10, and arm cylinder 11, and a bucket cylinder 12. The boom cylinder 10, the arm cylinder 11, and the bucket cylinder 12 are hydraulic cylinders that are driven by hydraulic fluid. The boom cylinder 10 drives the boom 6. The arm cylinder 11 drives the arm 7. The bucket cylinder 12 drives the bucket 8.

Figure 2:
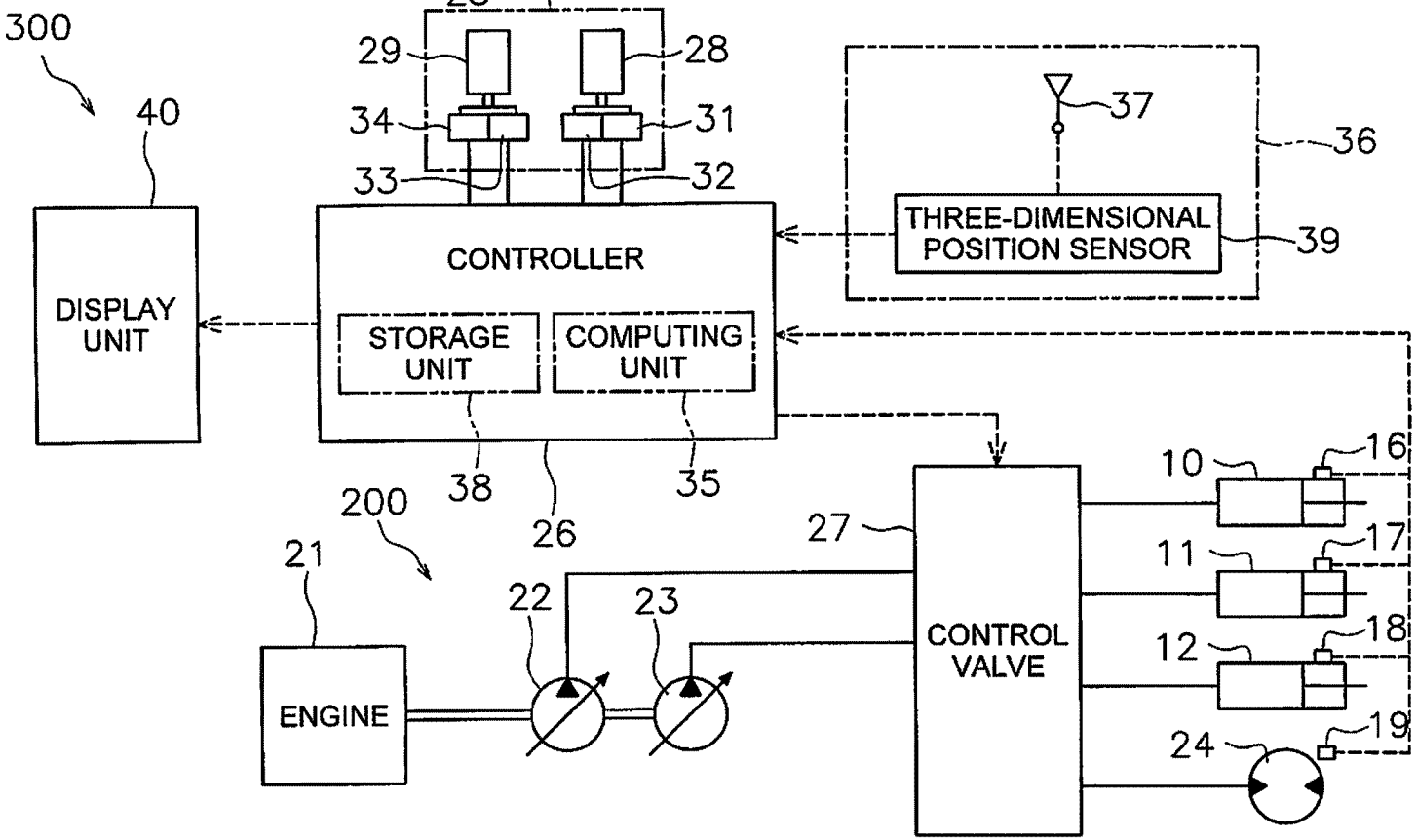
FIG. 2 is a block diagram illustrating a configuration of a control system in the work vehicle.

FIG. 2 is a block diagram illustrating a configuration of a control system 300 and a drive system 200 provided in the work vehicle 100. As illustrated in FIG. 2, the drive system 200 is provided with an engine 21 and hydraulic pumps 22 and 23.

The hydraulic pumps 22 and 23 are driven by the engine 21 to discharge hydraulic fluid. The boom cylinder 10, the arm cylinder 11, and the bucket cylinder 12 are supplied with hydraulic fluid discharged from the hydraulic pumps 22 and 23. The work vehicle 100 is also provided with a revolution motor 24. The revolution motor 24 is a hydraulic motor and is driven by hydraulic fluid discharged from the hydraulic pumps 22 and 23. The revolution motor 24 rotates the revolving body 3.

While two hydraulic pumps 22 and 23 are illustrated in FIG. 2, only one hydraulic pump may be provided. The revolution motor 24 is not limited to a hydraulic motor and may be an electric motor.

The control system 300 is provided with an operating device 25, a controller 26, and a control valve 27. The operating device 25 is a device for operating the work implement 2. The operating device 25 receives operations from an operator for driving the work implement 2 and outputs operation signals in accordance with an operation amount. The operating device 25 has a first operating member 28 and a second operating member 29.

The first operating member 28 is, for example, an operation lever. The first operating member 28 is provided in a manner that allows operation in the four directions of front, back, left, and right. Two of the four operating directions of the first operating member 28 are assigned to a raising operation and a lowering operation of the boom 6. The remaining two operating directions of the first operating member 28 are assigned to a raising operation and a lowering operation of the bucket 8.

The second operating member 29 is, for example, an operation lever. The second operating member 29 is provided in a manner that allows operation in the four directions of front, back, left, and right. Two of the four operating directions of the second operating member 29 are assigned to a raising operation and a lowering operation of the arm 7. The remaining two operating directions of the second operating member 29 are assigned to a right revolving operation and a left revolving operation of the revolving body 3.

The contents of the operations assigned to the first operating member 28 and the second operating member 29 are not limited as described above and may be changed.

The operating device 25 has a boom operating portion 31 and a bucket operating portion 32. The boom operating portion 31 outputs a boom operation signal in accordance with an operation amount of the first operating member 28 (hereinbelow referred to as "boom operation amount") for operating the boom 6. The boom operation signal is input to the controller 26. The bucket operating portion 32 outputs a bucket operation signal in accordance with an operation amount of the first operating member 28 (hereinbelow referred to as "bucket operation amount") for operating the bucket 8. The bucket operation signal is input to the controller 26.

The operating device 25 has an arm operating portion 33 and a revolving operating portion 34. The arm operating portion 33 outputs arm operation signals in accordance with the operation amount of the second operating member 29 for operating the arm 7 (hereinbelow referred to as "arm operation amount"). The arm operation signals are input to the controller 26. The revolving operating portion 34 outputs revolving operation signals in accordance with an operation amount of the second operating member 29 for operating the revolution of the revolving body 3. The revolving operation signals are input to the controller 26.

The controller 26 is programmed to control the work vehicle 100 on the basis of obtained information. The controller 26 has a storage unit 38 and a computing unit 35. The storage unit 38 is configured by a memory, such as a RAM or a ROM, for example, and an auxiliary storage device. The computing unit 35 is configured by a processing device, such as a CPU, for example. The controller 26 obtains the boom operation signals, the arm operation signals, the bucket operation signals, and the revolution operation signals from the operating device 25. The controller 26 controls the control valve 27 on the basis of the operation signals.

The control valve 27 is an electromagnetic proportional control valve and is controlled by command signals from the controller 26. The control valve 27 is disposed between the hydraulic pumps 22 and 23 and hydraulic actuators, such as the boom cylinder 10, the arm cylinder 11, the bucket cylinder 12, and the revolution motor 24. The control valve 27 controls the flow rate of the hydraulic fluid supplied from the hydraulic pumps 22 and 23 to the boom cylinder 10, the arm cylinder 11, the bucket cylinder 12, and the revolution motor 24. The controller 26 controls command signals to the control valve 27 so that the work implement 2 operates at a velocity in accordance with the operation amounts of each of the above-mentioned operating members. As a result, the outputs of the boom cylinder 10, the arm cylinder 11, the bucket cylinder 12, and the revolution motor 24 are controlled in response to the operation amounts of the respective operating members.

The control valve 27 may be a pressure proportional control valve. In such a case, pilot pressures in accordance with the operation amounts of the respective operating members are outputted from the boom operating portion 31, the bucket operating portion 32, the arm operating portion 33, and the revolving operating portion 34 and inputted to the control valve 27. The control valve 27 controls the flow rate of the hydraulic fluid supplied to the boom cylinder 10, the arm cylinder 11, the bucket cylinder 12, and the revolution motor 24 in response to the inputted pilot pressures.

The control system 300 has a first stroke sensor 16, a second stroke sensor 17, and a third stroke sensor 18. The first stroke sensor 16 detects a stroke length of the boom cylinder 10 (hereinbelow referred to as "boom cylinder length"). The second stroke sensor 17 detects a stroke length of the arm cylinder 11 (hereinbelow referred to as "arm cylinder length"). The third stroke sensor 18 detects a stroke length of the bucket cylinder 12 (hereinbelow referred to as "bucket cylinder length"). An angle sensor may be used for measuring the stroke.

The control system 300 is provided with a tilt angle sensor 19. The tilt angle sensor 19 is arranged in the revolving body 3. The tilt angle sensor 19 detects the angle (pitch angle) relative to horizontal in the vehicle front-back direction of the revolving body 3 and the angle (roll angle) relative to horizontal in the vehicle lateral direction.

The sensors 16 to 19 send detection signals to the controller 26. The revolution angle may also be obtained from position information of a belowmentioned GNSS antenna 37. The controller 26 determines the attitude of the work implement 2 on the basis of the detection signals from the sensors 16 to 19.

The control system 300 is provided with a position detecting unit 36. The position detecting unit 36 detects the current position of the work vehicle 100. The position detecting unit 36 has the GNSS antenna 37 and a three-dimensional position sensor 39. The GNSS antenna 37 is provided on the revolving body 3. The GNSS antenna 37 is an antenna for a Real-time Kinematic—Global Navigation Satellite System. Signals corresponding to GNSS radio waves received by the GNSS antenna 37 are input into the three-dimensional position sensor 39.

Figure 3:
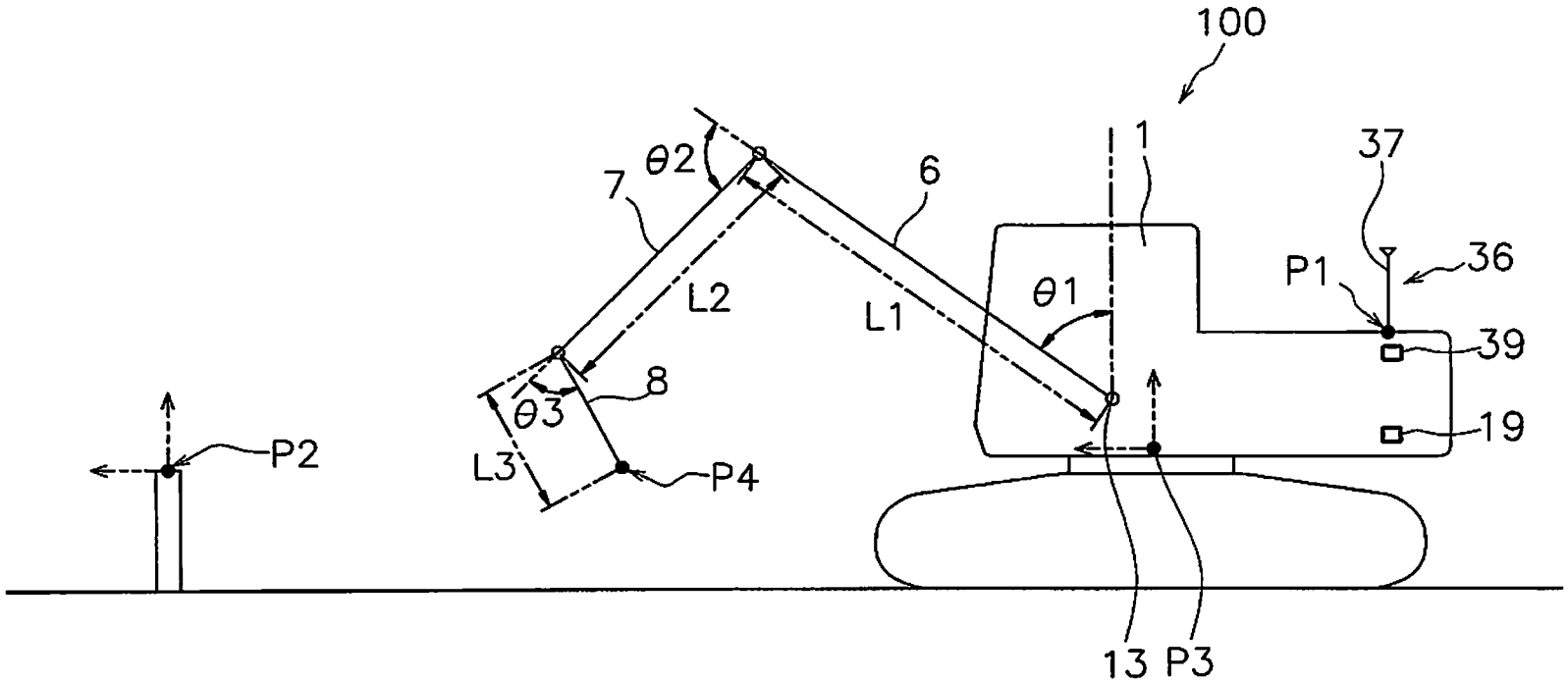
FIG. 3 is a side view schematically illustrating a configuration of the work vehicle.

FIG. 3 is a side view schematically illustrating a configuration of the work vehicle 100. The three-dimensional position sensor 39 detects an installation position P1 of the GNSS antenna 37 in a global coordinate system. The global coordinate system is a three-dimensional coordinate system based on a reference position P2 installed in a work area. As illustrated in FIG. 3, the reference position P2 is, for example, a position at the distal end of a reference marker set in the work area. The controller 26 computes the position of a cutting edge P4 of the work implement 2 as seen in the global coordinate system on the basis of the detection results from the position detecting unit 36 and the attitude of the work implement 2. The cutting edge P4 of the work implement 2 may be expressed by the cutting edge P4 of the bucket 8.

The controller 26 calculates a slope angle θ1 of the boom 6 with respect to the vertical direction in the local coordinate system from the boom cylinder length detected by the first stroke sensor 16. The controller 26 calculates a slope angle θ2 of the arm 7 with respect to the boom 6 from the arm cylinder length detected by the second stroke sensor 17. The controller 26 calculates a slope angle θ3 of the bucket 8 with respect to the arm 7 from the bucket cylinder length detected by the third stroke sensor 18.

The storage unit 38 in the controller 26 stores work implement data. The work implement data includes a length L1 of the boom 6, a length L2 of the arm 7, and a length L3 of the bucket 8. The work implement data includes position information of a boom pin 13 with respect to the reference position P3 in the local coordinate system. The local coordinate system is a three-dimensional system based on the hydraulic excavator 100. A reference position P3 in the local coordinate system is a position at the center of rotation of the revolving body 3.

The controller 26 calculates the position of the cutting edge P4 in the local coordinate system from the slope angle θ1 of the boom 6, the slope angle θ2 of the arm 7, the slope angle θ3 of the bucket 8, the length L1 of the boom 6, the length L2 of the arm 7, the length L3 of the bucket 8, and the position information of the boom pin 13.

The work implement data includes position information of the installation position P1 of the GNSS antenna 37 with respect to the reference position P3 in the local coordinate system. The controller 26 converts the position of the cutting edge P4 in the local coordinate system to the position of the cutting edge P4 in the global coordinate system based on the detection results of the position detecting unit 36 and the position information of the GNSS antenna 37. As a result, the controller 26 obtains the position information of the cutting edge P4 as seen in the global coordinate system.

The storage unit 38 in the controller 26 stores construction information indicating positions and shapes of a three-dimensional design terrain inside the work area. The controller 26 displays the design terrain on a display unit 40 on the basis of the design terrain and the detection results from the abovementioned sensors. The display unit 40 is, for example, a monitor and displays various types of information of the hydraulic excavator 100.

Figure 4:
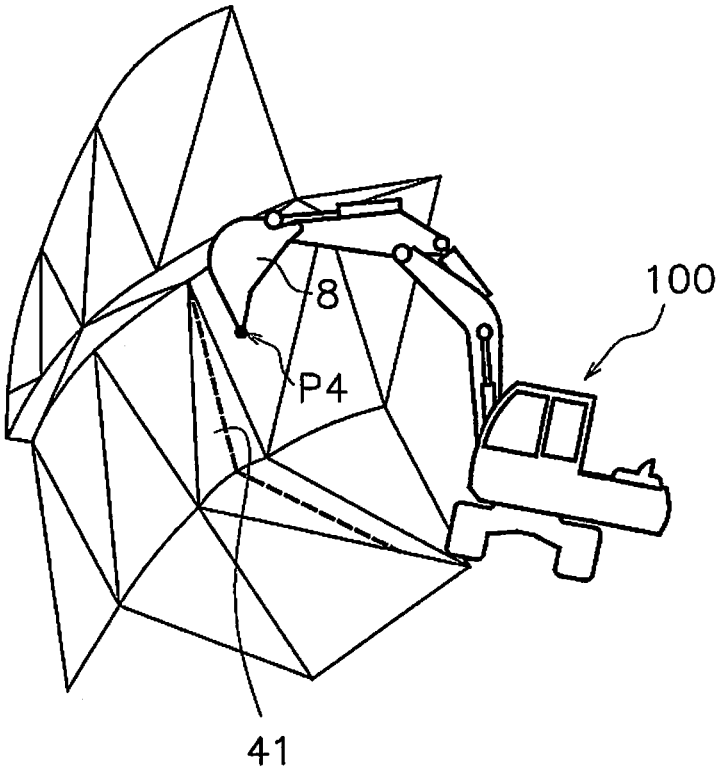
FIG. 4 is a schematic view of an example of a design terrain.

FIG. 4 is a schematic view of an example of a design terrain. As illustrated in FIG. 4, the design terrain is configured by a plurality of design planes 41 that are each represented by polygons. The plurality of design planes 41 represent a target shape to be excavated by the work implement 2. Only one of the plurality of design planes 41 is provided with the reference numeral 41 in FIG. 4, and reference numerals for the other design planes 41 are omitted.

The controller 26 performs velocity limit control by limiting the velocity of the work implement 2 toward the design planes in order to prevent the bucket 8 from penetrating the design plane 41. The velocity limit control performed by the controller 26 is described in detail below.

Figure 5:
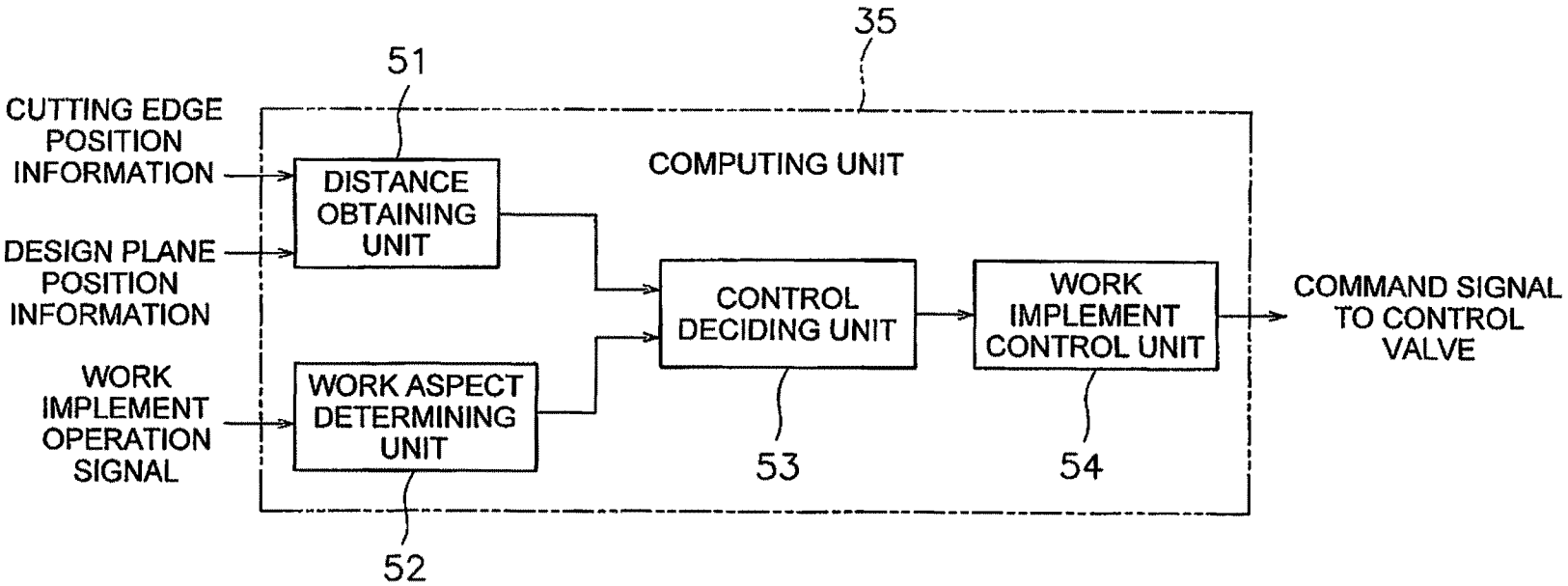
FIG. 5 is a block diagram of a configuration of a controller.
Figure 6:
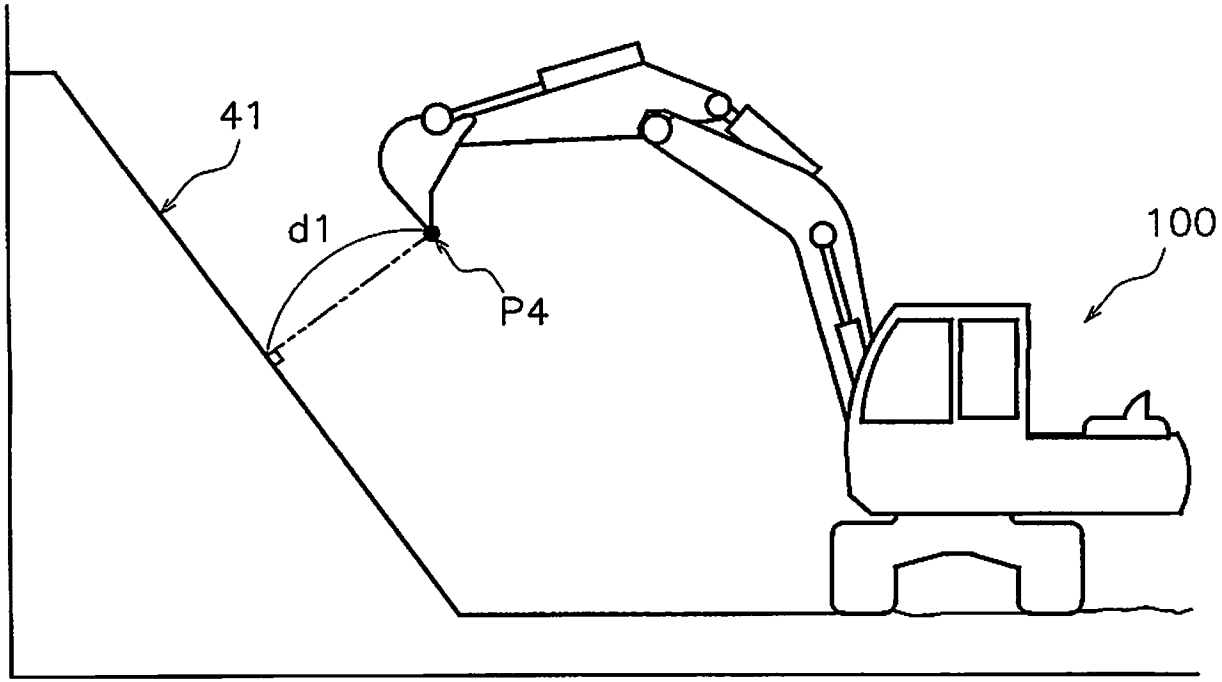
FIG. 6 is a schematic view illustrating the distance between a work implement and the design terrain.

FIG. 5 is a block diagram of a configuration of the controller 26. The computing unit 35 of the controller 26 has a distance obtaining unit 51, a work aspect determining unit 52, a control deciding unit 53, and a work implement control unit 54. As illustrated in FIG. 6, the distance obtaining unit 51 obtains a distance d1 between the work implement 2 and the design plane 41. Specifically, the distance obtaining unit 51 calculates the distance d1 between the cutting edge P4 of the work implement 2 and the design plane 41 on the basis of the above-mentioned position information of the cutting edge P4 of the work implement 2 and the position information of the design plane 41.

The work aspect determining unit 52 determines the work aspect of the work implement 2. The work aspect determining unit 52 determines whether the work aspect of the work implement 2 is surface compaction work or not on the basis of the above-mentioned operation signals of the work implement 2. The surface compaction work is work for striking the ground surface with the floor surface (bottom surface) of the bucket 8 to harden the ground surface. The control deciding unit 53 limits the velocity of the work implement 2 as the distance d1 between the work implement 2 and the design plane 41 grows smaller in the velocity limit control.

The work implement control unit 54 controls the work implement 2 by outputting command signals to the above-mentioned control valve 27. The work implement control unit 54 decides the output values of the command signals to the control valve 27 in accordance with the operation amount of the work implement 2.

Figure 7:
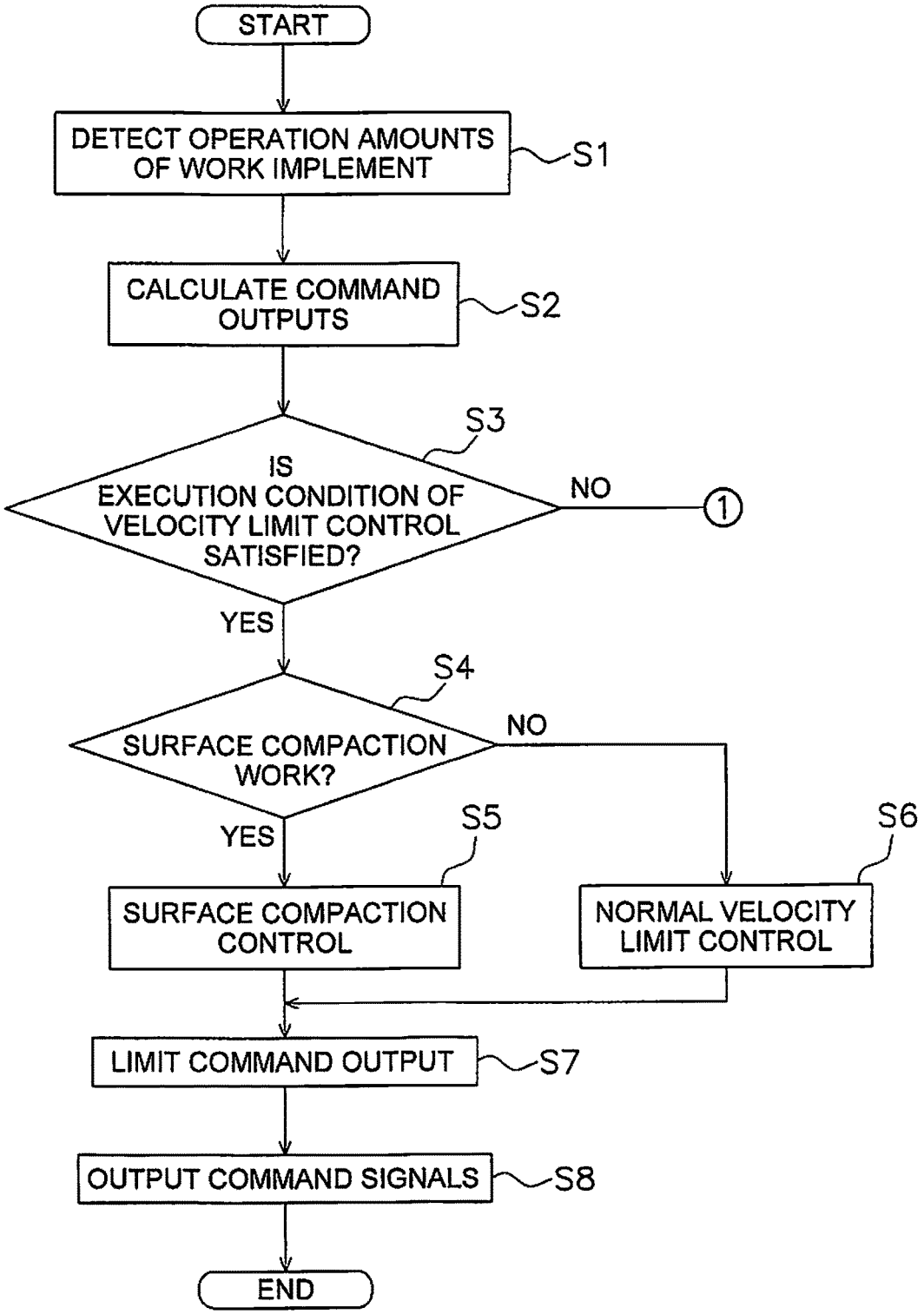
FIG. 7 is a flow chart of processing for a velocity limit control.

FIG. 7 is a flow chart illustrating processing for the velocity limit control. The operation amounts of the work implement 2 are detected in step S1 as illustrated in FIG. 7. Here, the above-mentioned boom operation amount, the bucket operation amount, and the arm operation amount are detected.

In step S2, the command outputs are calculated. Here, the output values of the command signals transmitted to the control valve 27 are calculated when the velocity is not being limited. The work implement control unit 54 calculates the output values of the command signals to the control valve 27 in accordance with the detected boom operation amount, the bucket operation amount, and the arm operation amount.

A determination is made in step S3 as to whether an execution condition for the velocity limit control is satisfied. Here, the work aspect determining unit 52 determines that the execution condition of the velocity limit control is satisfied on the basis of the boom operation amount, the bucket operation amount, and the arm operation amount. For example, the work aspect determining unit 52 determines that the execution condition for the velocity limit control is satisfied when an arm operation is not being performed although a boom operation or a bucket operation is being performed.

In step S4, a determination is made as to whether the work aspect is surface compaction work or not. The work aspect determining unit 52 determines whether a surface compaction determination condition that indicates that the work performed by the work implement 2 is surface compaction work is satisfied. The surface compaction determination condition includes the operation of the boom 6.

Figure 8:
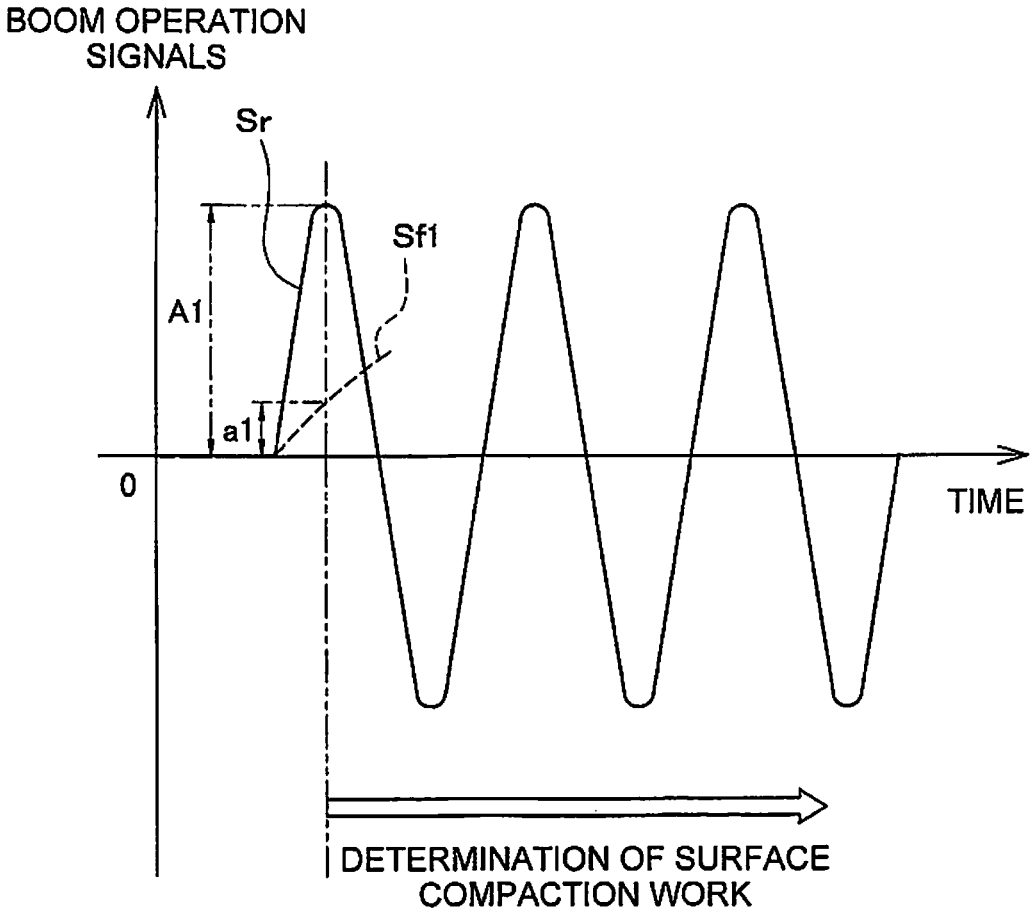
FIG. 8 illustrates an example of surface compaction work determination processing.

FIG. 8 illustrates an example of surface compaction work determination processing. The vertical axis in FIG. 8 indicates the boom operation signals from the first operating member 28. The horizontal axis indicates time. The values of the boom operation signals being positive indicate a lowering operation of the boom 6. The values of the boom operation signals being negative indicate a raising operation of the boom 6. The boom operation signal being zero indicates that the first operating member 28 is in the neutral position.

Sr in FIG. 8 indicates the actual boom operation signal. Sf1 indicates a boom operation signal subjected to low-pass filtering. A1 is the actual operation signal from the boom operation. a1 is a value of the boom operation signal subjected to low-pass filtering.

As illustrated in FIG. 8, the work aspect determining unit 52 determines that the work aspect is the surface compaction work when the equation a1/A1<r1 (surface compaction determination condition) is satisfied. r1 is a constant less than one. While the case of a lowering operation of the boom 6 is depicted in FIG. 8, the raising operation of the boom 6 may also be determined in the same way. Moreover, while A1 is the peak value of the boom operation signal in FIG. 8, A1 may be a value other than the peak value.

When the work aspect is determined as the surface compaction work in step S4, the routine advances to step S5. In step S5, the control deciding unit 53 executes the surface compaction control. The control deciding unit 53 decides a limit velocity on the basis of first limit velocity information I1 illustrated in FIG. 9 during the surface compaction control. When the surface compaction determination condition is not met in the step S4, the routine advances to step S6. In step S6, the control deciding unit 53 executes the normal velocity limit control. In the normal velocity limit control, the control deciding unit 53 decides a limit velocity on the basis of second limit velocity information I2 illustrated in FIG. 9. The limit velocity is the upper limit of the velocity of the cutting edge P4 of the work implement 2 in the vertical direction toward the design plane 41.

Figure 9:
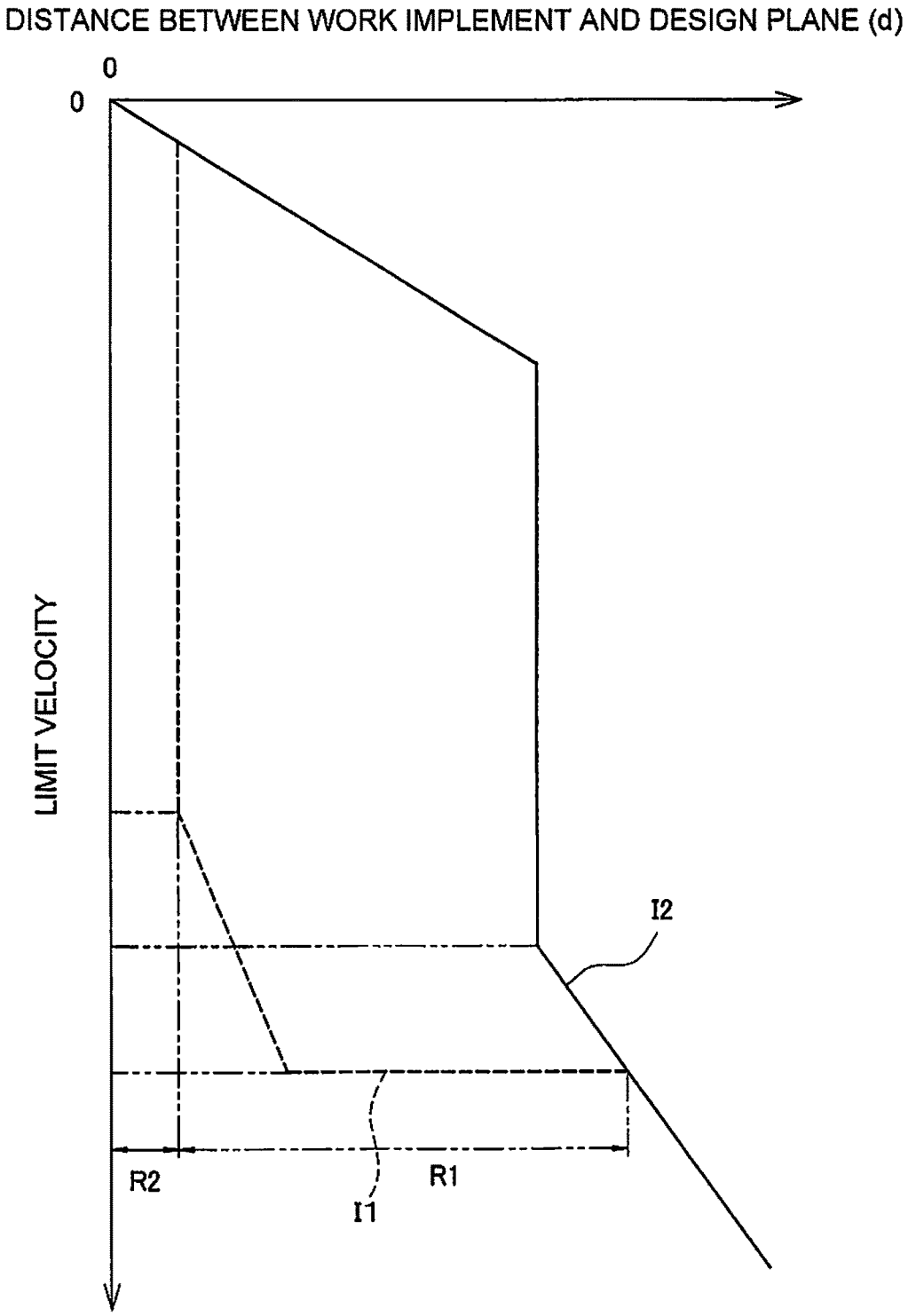
FIG. 9 illustrates first limit velocity information and second limit velocity information.

As illustrated in FIG. 9, the first limit velocity information I1 defines the relationship between the distance d1 between the work implement 2 and the design plane 41 and the limit velocity when the work aspect is the surface compaction work. The second limit velocity information I2 defines the relationship between the distance d1 between the work implement 2 and the design plane 41 and the limit velocity when the work aspect is a work other than the surface compaction work. The first limit velocity information I1 and the second limit velocity information I2 are stored in the storage unit 38.

As illustrated in FIG. 9, the first limit velocity information I1 and the second limit velocity information I2 match when the distance d1 is greater than a first range R1. When the distance d1 is within the first range R1, the limit velocity based on the first limit velocity information I1 is greater than the limit velocity based on the second limit velocity information I2. Therefore, the limit velocity during the surface compaction control is greater than the limit velocity during the normal velocity limit control when the distance d1 is within the first range R1. When the distance d1 is within a second range R2, the first limit velocity information I1 matches the second limit velocity information I2. Therefore, the limit velocity during surface compaction work is the same as the limit velocity during the normal velocity limit control while the distance d1 is within the second range R2.

As described above, the control deciding unit 53 reduces the limit velocity of the work vehicle 100 toward the design plane 41 in correspondence to a reduction in the distance d1 between the work implement 2 and the design plane 41 in the normal velocity limit control. As a result, the velocity of the work implement 2 is limited in correspondence to a reduction in the distance d1 between the work implement 2 and the design plane 41. Consequently, the work implement 2 over-exceeding the design terrain 41 and excavating, for example, can be restricted during excavation.

In the same way as in the surface compaction control, the velocity of the work implement 2 is limited in correspondence to a reduction in the distance d1 between the work implement 2 and the design plane 41. As a result, the work implement 2 over-exceeding the design terrain 41 and excavating can be restricted during the surface compaction work.

Moreover, the limit velocity during the surface compaction control is greater than the limit velocity during the normal velocity limit control when the distance d1 is within the first range R1. Therefore, when the work aspect is the surface compaction work and the distance d1 between the work implement 2 and the design terrain 41 is within the first range R1, the limit velocity of the work implement 2 is increased in comparison to when the work aspect is an aspect of a work other than surface compaction. As a result, the work implement 2 is made to strike the ground during surface compaction work at a velocity greater than that during excavation work. As a result, the surface compaction work can be carried out in a favorable manner.

In step S7, the work implement control unit 54 limits the command output. Here, the work implement control unit 54 decides the command output to the control valve 27 so that the velocity of the work implement 2 does not exceed the limit velocity decided in step S5 or step Sb.

Specifically, a vertical speed component of an estimated velocity of the work implement 2 is calculated on the basis of the boom operation amount and the bucket operation amount. The vertical speed component is the velocity of the cutting edge P4 of the work implement 2 in the vertical direction to the design plane 41. When the vertical speed component of the estimated velocity is greater than the limit velocity, a ratio of the limit velocity with respect to the vertical speed component of the estimated velocity is calculated. A value derived by multiplying the estimated velocity of the boom cylinder 10 based on the boom operation amount by the ratio is decided as a target velocity of the boom cylinder 10. Similarly, the value derived by multiplying the estimated velocity of the bucket cylinder 12 based on the bucket operation amount by the ratio is decided as the target velocity of the bucket cylinder 12. The command outputs to the control valve 26 are decided so that the boom cylinder 10 and the bucket cylinder 12 operate at the target velocities.

When only the boom 6 is operated, only the target velocity of the boom 6 is decided. When only the bucket 8 is operated, only the target velocity of the bucket 8 is decided.

In step S8, the command signals are outputted. Here, the work implement control unit 54 outputs the command signals decided in step S7 to the control valve 27. As a result, the work implement control unit 54 controls the work implement 2 so that the velocity of the work implement 2 becomes smaller as the distance d1 between the design plane 41 and the work implement 2 becomes smaller in the velocity limit control. Moreover, the work implement control unit 54 controls the work implement 2 so that the velocity of the work implement 2 becomes larger in comparison to when the work aspect is a work other than surface compaction when the work aspect is the surface compaction work and the distance d1 is within the first range R1.

Figure 10:
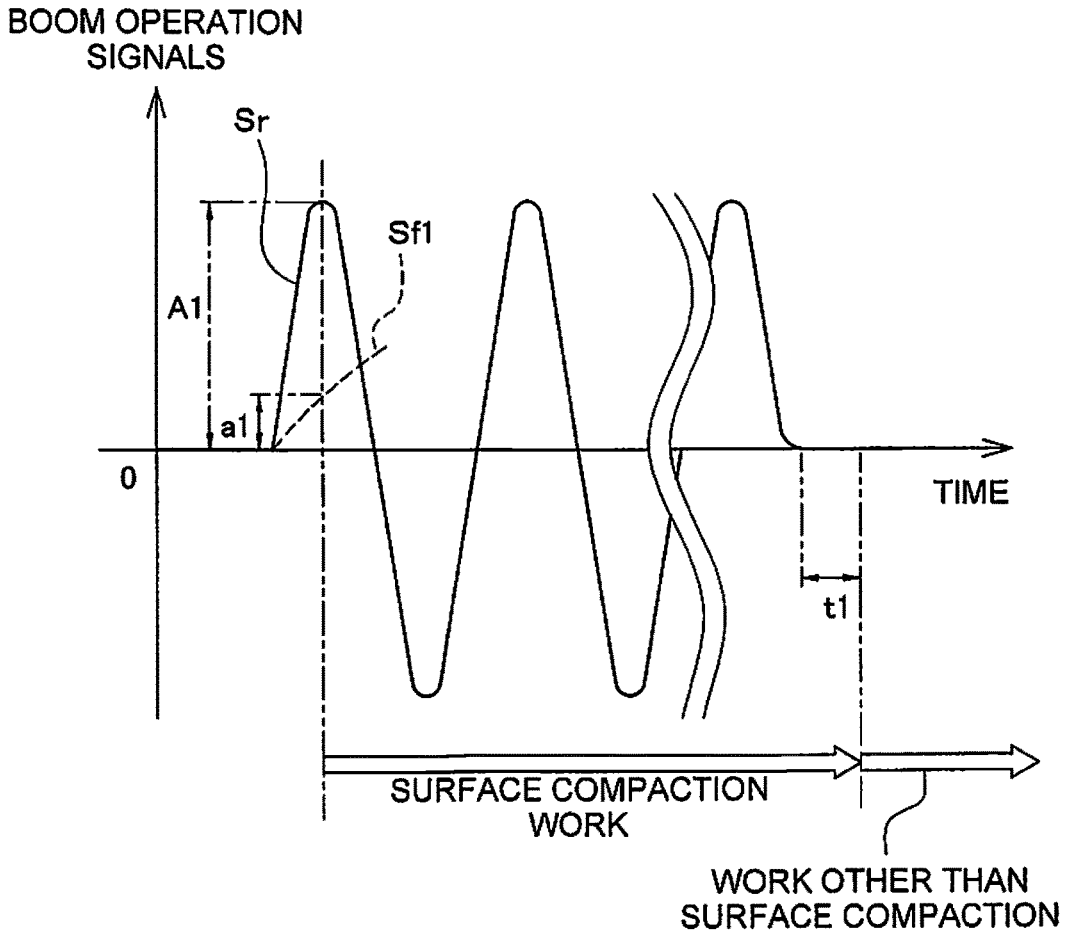
FIG. 10 illustrates an example of determination processing of the completion of surface compaction work.

As illustrated in FIG. 10, the work aspect determining unit 52 determines that the surface compaction work is finished and the work aspect has been changed to work other than surface compaction when the state of the first operating member 28 being in the neutral position is continued for a predetermined first determination time t1.

Figure 11:
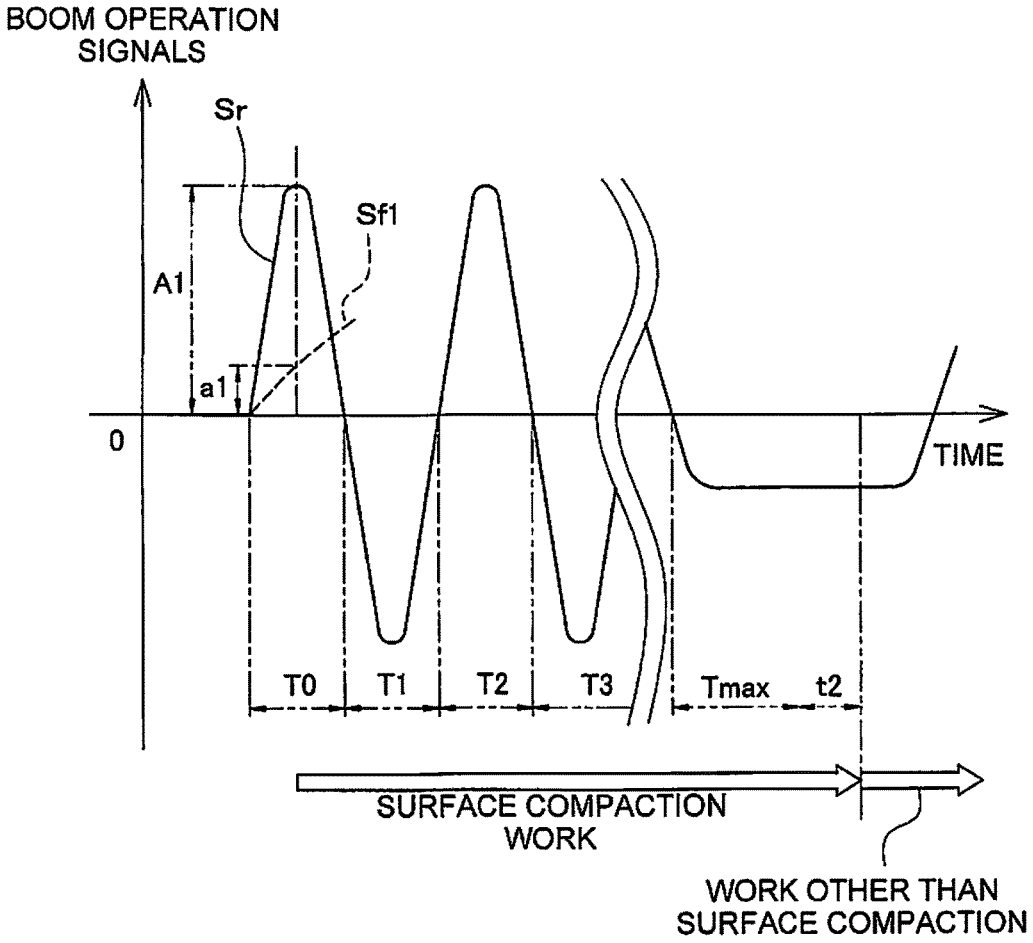
FIG. 11 illustrates an example of determination processing of the completion of surface compaction work.

Moreover, as illustrated in FIG. 11, the work aspect determining unit 52 determines that the surface compaction work is finished and the work aspect has been changed to work other than surface compaction when the state of the first operating member 28 being operated in the same direction is continued for a predetermined second determination time Tmax+t2. "Tmax" is the maximum value of consecutive times T0, T1, T2, T3, . . . of the state in which the first operating member 28 is being operated in the same direction. "t2" is a predetermined constant.

Figure 12:
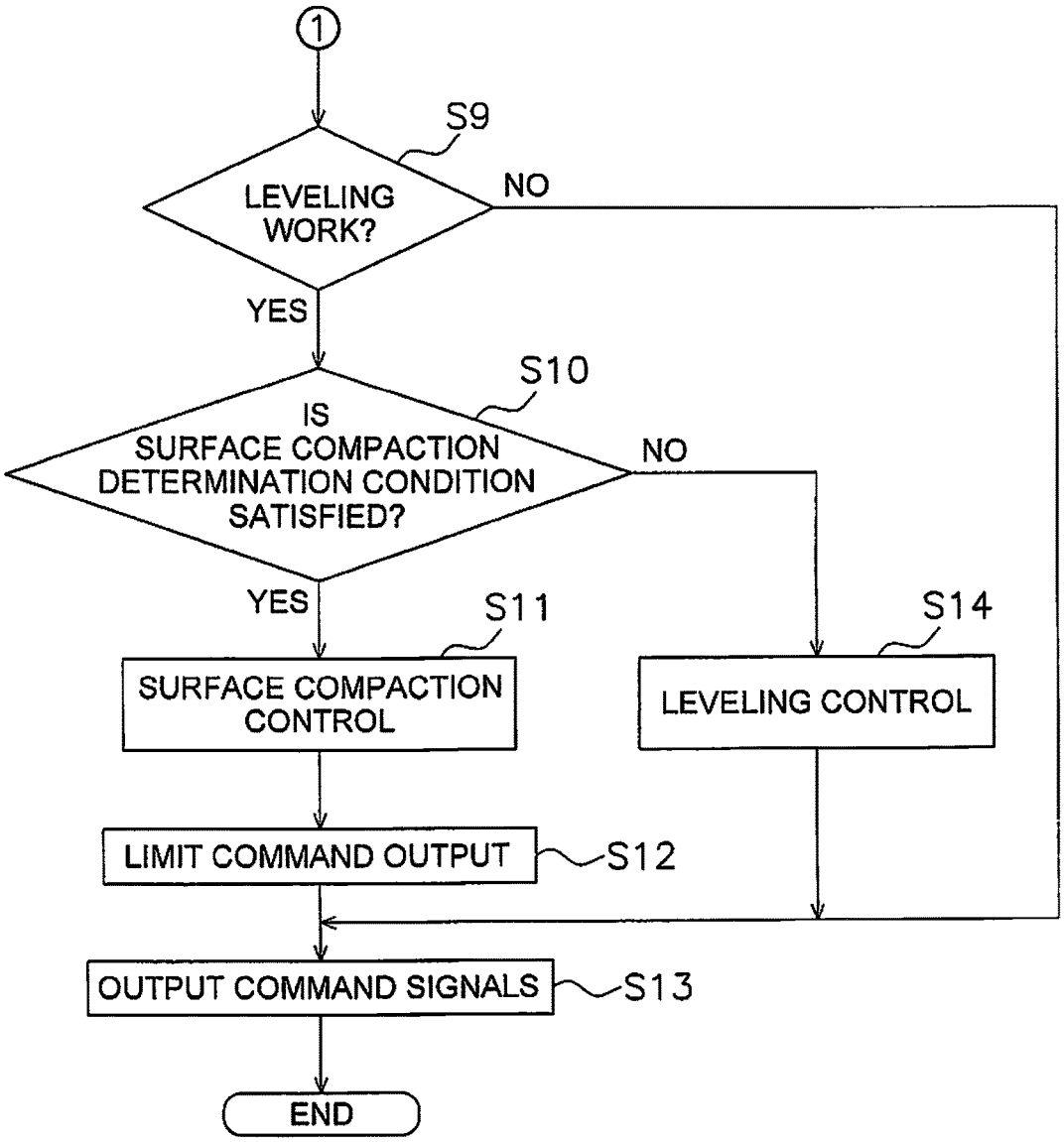
FIG. 12 is a flow chart illustrating determination processing for a surface compaction control and a leveling control.

When the execution condition of the velocity limit control is not satisfied in step S3, the routine advances to step S9 indicated in FIG. 12. In step S9, the work aspect determining unit 52 determines whether the work aspect is the leveling work. The work aspect determining unit 52 determines that the work aspect is the leveling work when a leveling determination condition is satisfied. The leveling determination condition is a determination condition indicating that the work carried out by the work implement 2 is leveling work. Specifically, the leveling determination condition is that an operation of the arm 7 is being performed. It is determined that the leveling determination condition is satisfied when an operation of the arm 7 is being performed regardless of whether there is an operation of the boom 6 and/or the bucket 8. When the work aspect is the leveling work, that is, when the leveling determination condition is satisfied, the routine advances to step S10.

In step S10, the work aspect determining unit 52 determines whether the surface compaction determination condition is satisfied. When the above-mentioned surface compaction determination condition is satisfied, the control deciding unit 53 executes the surface compaction control in step S11. Here, the control deciding unit 53 decides the limit velocity of the work implement on the basis of the above-mentioned first limit velocity information I1.

Next in step S12, the work implement control unit 54 limits the command output. Here, the work implement control unit 54 decides the command output to the control valve 27 in the same way as in step S7 so that the velocity of the work implement 2 does not exceed the limit velocity decided in step S11.

In step S13, the command signals are outputted. The work implement control unit 54 outputs the command signals decided in step S12 to the control valve 27 in the same way as in step S8.

When the surface compaction determination condition is not met in the step S10, the routine advances to step S14. In step S14, the control deciding unit 53 executes the leveling control. The leveling control is a control for controlling the work implement 2 so that the work implement 2 moves along the design plane 41.

Figure 13:
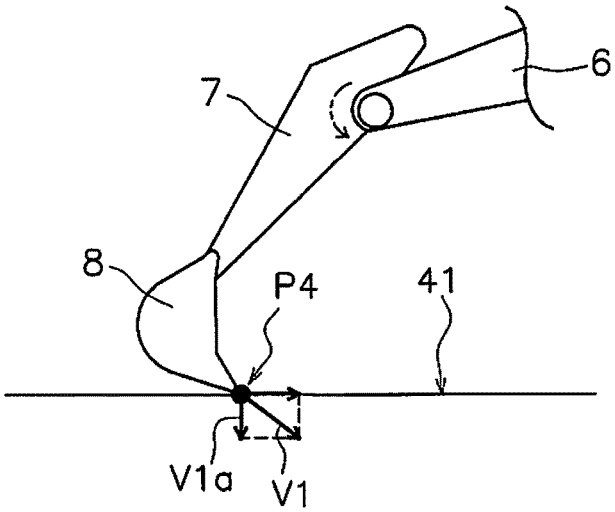
FIG. 13 illustrates velocity control of the work implement during leveling control.

For example, when the arm 7 is driven, the cutting edge P4 of the work implement 2 follows an arc-like trajectory. Consequently as illustrated in FIG. 13, the cutting edge P4 exceeds the design plane 41 and excavates when the cutting edge P4 moves at a velocity V1.

The control deciding unit 53 controls the work implement 2 so that the cutting edge P4 moves along the design plane 41 in the leveling control. Specifically, as illustrated in FIG. 13, the control deciding unit 53 calculates a vertical speed component V1*a* that is vertical with respect to the design plane 41 from the velocity V1 of the cutting edge P4 when the cutting edge P4 moves in the direction approaching the design plane 41. The control deciding unit 53 then decides a velocity for raising the boom 6 so that the vertical speed component V1*a* is canceled out.

In step S13, the work implement control unit 54 then outputs the command signals corresponding to the velocity decided in step S14. The above-mentioned processing in FIG. 7 and FIG. 12 are repeatedly performed while the work vehicle 100 is working.

In the control system 300 of the work vehicle 100 according to the present exemplary embodiment discussed above, the leveling control is executed when the leveling determination condition is satisfied and the surface compaction determination condition is not satisfied. Moreover, the surface compaction control is carried out when the surface compaction determination condition is satisfied. As a result, the leveling work and the surface compaction work can be carried out in a favorable manner.

Moreover, the surface compaction control is executed when the surface compaction determination condition is satisfied even when the leveling determination condition is satisfied. That is, the surface compaction control takes precedence over the leveling control. Therefore, the surface compaction work is maintained even if the leveling control condition is satisfied while the surface compaction control is being executed. As a result, a case in which the leveling control is executed by mistake can be suppressed even when an operation that can be easily confused with an operation during leveling work is carried out during surface compaction work. Moreover, the leveling control is released and the surface compaction control is executed when the surface compaction determination condition is satisfied while the leveling control is being executed. As a result, the surface compaction work can be carried out promptly after the leveling work.

Although exemplary embodiments of the present invention have been described so far, the present invention is not limited to the above exemplary embodiments and various modifications may be made within the scope of the invention.

The work vehicle 100 is not limited to a hydraulic excavator and may be any work vehicle having a bucket, such as a backhoe loader and the like. Moreover, a crawler-type hydraulic excavator and a wheel-type hydraulic excavator are included as the hydraulic excavator.

The work vehicle 100 may be remotely operated. That is, the controller 26 may be divided into a remote controller disposed outside of the work vehicle 100 and an on-board controller disposed inside the work vehicle 100, and the two controllers may be configured to allow communication therebetween.

The properties of the first limit velocity information I1 are not limited to those in the above exemplary embodiments and may be changed. The properties of the second limit velocity information I2 are not limited to those in the above exemplary embodiments and may be changed. Alternatively, the normal velocity limit control may be omitted.

The method for determining the position of the cutting edge P4 of the work implement 2 is not limited to the method described in the above exemplary embodiments and may be modified. For example, the position detecting unit 36 may be disposed on the cutting edge P4 of the work implement 2.

The method for detecting the distance d1 between the work implement 2 and the design plane 41 is not limited to the method described in the above exemplary embodiments and may be modified. For example, the distance d1 between the work implement 2 and the design plane 41 may be detected by an optical, an ultrasound, or a laser beam-type distance measuring device.

The control deciding unit 53 cancels the leveling control and executes the surface compaction control when the surface compaction determination condition is satisfied while the leveling control is being executed. However, the control deciding unit 53 may only cancel the leveling control when the surface compaction determination condition is satisfied while the leveling control is being executed. That is, the control deciding unit 53 may cancel the leveling control and may change to a manual mode when the surface compaction determination condition is satisfied while the leveling control is being executed. The manual mode is a control mode for operating the work implement 2 manually without assistance from an automatic control such as the above-mentioned leveling control or the surface compaction control.

Figure 14:
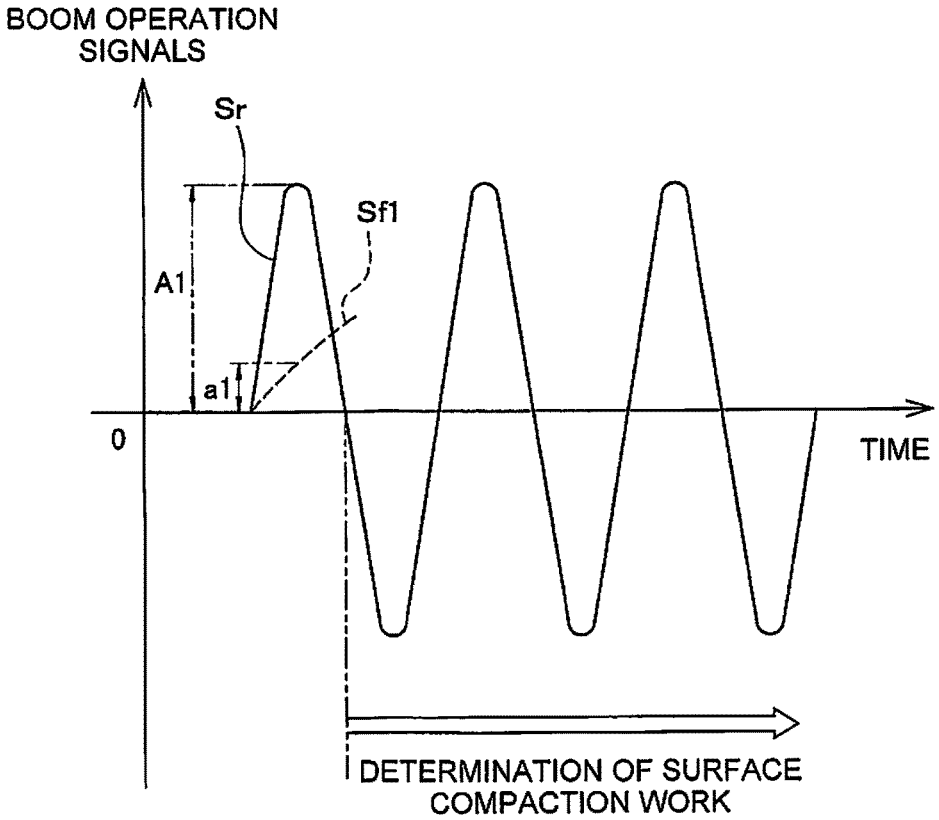
FIG. 14 illustrates an example of determination processing of the surface compaction work according to another exemplary embodiment.

The surface compaction determination condition not limited to the above exemplary embodiments and may be changed. For example as illustrated in FIG. 14, the work aspect determining unit 52 may decide that the work aspect is the surface compaction work when the operating direction of the boom 6 is reversed (second surface compaction condition) after the equation a1/A1<r1 (first surface compaction condition) is satisfied.

Figure 15:
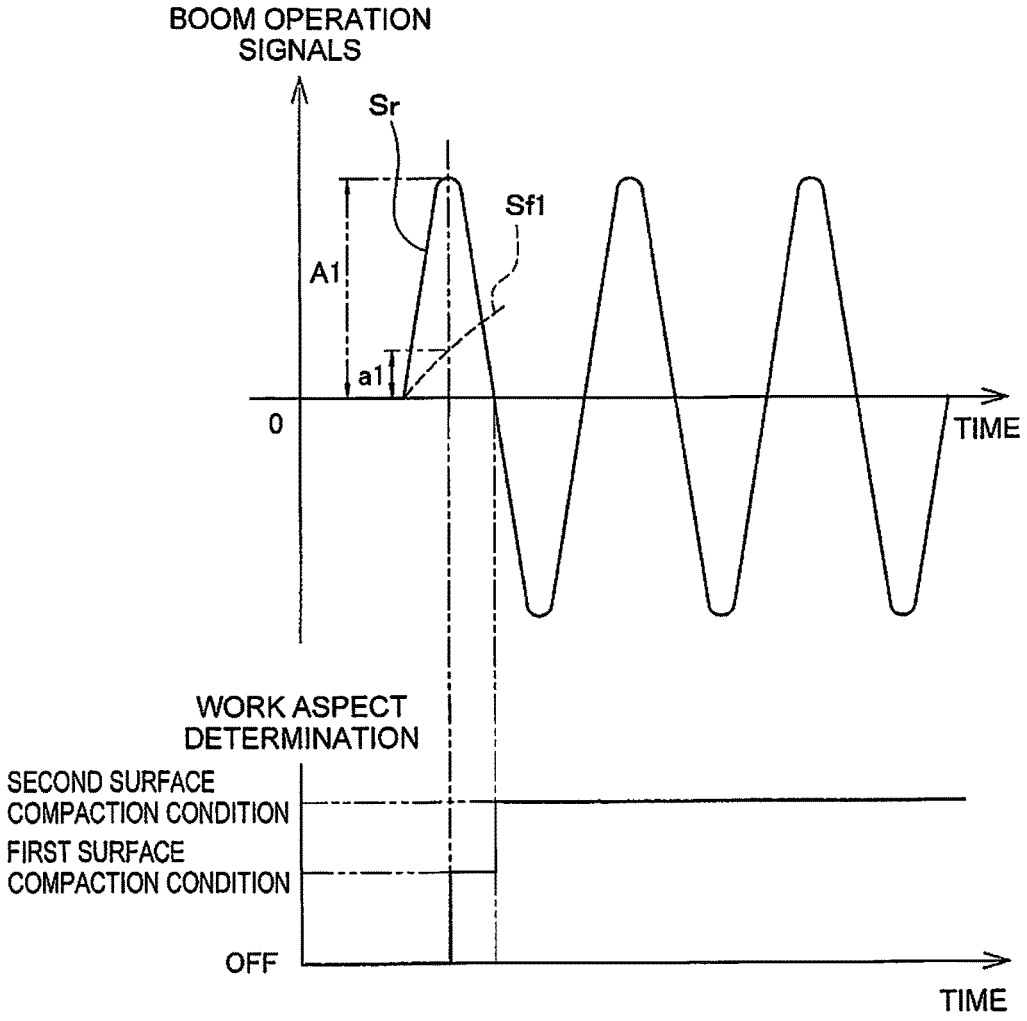
FIG. 15 illustrates an example of determination processing of the surface compaction work according to still another exemplary embodiment.

Alternatively as illustrated in FIG. 15, the work aspect determining unit 52 may determine that the work aspect is a first surface compaction state when the equation a1/A1<r1 (first surface compaction condition) is satisfied. The work aspect determining unit 52 may then determine that the work aspect is a second surface compaction state when the operating direction of the boom 6 is reversed (second surface compaction condition) after the first surface compaction condition is satisfied. That is, the work aspect determining unit 52 may determine that the work aspect is the second surface compaction state when the second surface compaction condition is satisfied following the first surface compaction condition.

The control deciding unit 53 may start the above-mentioned surface compaction control when the work aspect is the first surface compaction state. The control may be changed from the surface compaction control to the leveling control when the leveling determination condition is satisfied when the work aspect is the first surface compaction state. As a result, work for leveling the ground surface can be carried out easily after the surface compaction. Moreover, the control deciding unit 53 may maintain the surface compaction control when the leveling determination condition is satisfied when the work aspect is the second surface compaction state. As a result, a case in which the leveling control is executed by mistake can be suppressed even when an operation that can be easily confused with an operation during leveling work is carried out during surface compaction work.

While the distance obtaining unit 51 calculates the distance d1 between the cutting edge P4 of the work implement 2 and the design plane 41 in the above exemplary embodiments, the present invention is not limited in this way. The distance obtaining unit 51 may obtain the distance d1 between the work implement and the design terrain on the basis of position information of contour points of the bucket including the cutting edge P4, and position information of the design plane 41. In this case, the distance between the design plane and the contour point having the smallest distance to the design plane among the contour points of the bucket may be used as the distance between the work implement and the design terrain.

According to the present invention, leveling work and surface compaction work can be carried out favorably in the work vehicle.

What is claimed is:

1. A control system for a work vehicle including a work implement, the control system comprising:

at least one sensor;

an operating device including at least one operating member; and a controller including a memory and a processor, the controller being operatively connected to receive signals from the at least one sensor and the operating device, the controller being programmed to control the work implement based on the signals, obtain a distance between the work implement and a design terrain which represents a target shape of a work object based on the signals, determine whether a surface compaction determination condition indicating that work performed by the work implement is surface compaction work is satisfied based on the signals, and execute a surface compaction control in which a velocity of the work implement toward the design terrain is limited in response to the distance between the work implement and the design terrain when the surface compaction determination condition is satisfied.

2. The control system for the work vehicle according to claim 1, wherein the work implement includes a boom, an arm attached to a tip of the boom, and a work tool attached to a tip of the arm, and the surface compaction determination condition includes an operation of the boom.

3. The control system for the work vehicle according to claim 2, wherein the at least one sensor includes at least one of a stroke sensor of the boom, a stroke sensor of the arm, a stroke sensor of the work tool, a tilt angle sensor of the work vehicle, and a three-dimensional position sensor.

4. The control system for the work vehicle according to claim 1, wherein the controller is further programed to determine whether a leveling determination condition indicating that work performed by the work implement is leveling work is satisfied based on the signals, and execute a leveling control in which the work implement is controlled such that the work implement moves along the design terrain when the leveling determination condition is satisfied.

5. The control system for the work vehicle according to claim 4, wherein the controller is further programed to cancel the leveling control when the surface compaction determination condition is satisfied while the leveling control is being executed.

6. The control system for the work vehicle according to claim 4, wherein the controller is further programed to cancel the leveling control and execute the surface compaction control when the surface compaction determination condition is satisfied while the leveling control is being executed.

7. The control system for the work vehicle according to claim 4, wherein the work implement includes a boom, an arm attached to a tip of the boom, and a work tool attached to a tip of the arm, the leveling determination condition includes an operation of the arm.

8. The control system for the work vehicle according to claim 7, wherein the surface compaction determination condition includes an operation of the boom.

9. The control system for the work vehicle according to claim 4, wherein the controller is further programed to maintain the surface compaction control when the leveling determination condition is satisfied while the surface compaction control is being executed.

10. The control system for the work vehicle according to claim 9, wherein the surface compaction determination condition includes a first surface compaction condition and a second surface compaction condition, the controller is programmed to start the surface compaction control when the first surface compaction condition is satisfied, switch to the leveling control when the leveling determination condition is satisfied while the first surface compaction condition is satisfied and the second surface compaction condition is not satisfied, and maintain the surface compaction control when the leveling determination condition is satisfied while the second surface compaction condition is satisfied, the second surface compaction condition having been satisfied following a state in which the first surface compaction condition was satisfied.

11. The control system for the work vehicle according to claim 10, wherein the work implement includes a boom, an arm attached to a tip of the boom, and a work tool attached to a tip of the arm, the leveling determination condition includes an operation of the arm, and each of the first and second surface compaction conditions includes an operation of the boom.

12. The control system for the work vehicle according to claim 11, wherein the first surface compaction condition includes an operation of the boom in a predetermined direction, and the second surface compaction condition includes an operation of the boom in a direction reverse to the predetermined direction.

13. A control system for a work vehicle including a work implement, the control system comprising:

at least one sensor;

an operating device including at least one operating member, the operating device being configured to generate at least one operation signal in response to an operation of the at least one operating member; and a controller including a memory and a processor, the controller being operatively connected to receive at least one detection signal from the at least one sensor and to receive the at least one operation signal from the operating device, the controller being programmed to control the work implement based on the at least one operation signal, use the at least one detection signal to obtain a distance between the work implement and a design terrain which represents a target shape of a work object, use the at least one operation signal to determine whether a leveling determination condition indicating that work performed by the work implement is leveling work is satisfied, and to determine whether a surface compaction determination condition indicating that work performed by the work implement is surface compaction work is satisfied, the surface compaction determination condition including a first surface compaction condition and a second surface compaction condition, determine whether to execute a leveling control in which the work implement is controlled so that the work implement moves along the design terrain, or to execute a surface compaction control in which the velocity of the work implement towards the design terrain is limited in response to the distance between the work implement and the design terrain, start the surface compaction control when the first surface compaction condition is satisfied, switch to the leveling control when the leveling determination condition is satisfied while the first surface compaction condition is satisfied and the second surface compaction condition is not satisfied, and maintain the surface compaction control when the leveling determination condition is satisfied while the second surface compaction condition is satisfied, the second surface compaction condition having been satisfied following a state in which the first surface compaction condition was satisfied.

14. A control method for a work vehicle including a work implement, at least one sensor, an operating device, and a controller programmed to control the work implement based on signals from the at least one sensor and the operating device, the method comprising:

obtaining a distance between the work implement and a design terrain which represents a target shape of a work object based on the signals;

determining whether a leveling determination condition indicating that the work performed by the work implement is leveling work is satisfied based on the signals;

determining whether a surface compaction determination condition indicating that the work performed by the work implement is surface compaction work is satisfied based on the signals;

executing a leveling control in which the work implement is controlled such that the work implement moves along the design terrain when the leveling determination condition is satisfied;

executing a surface compaction control in which the velocity of the work implement toward the design terrain is limited in response to the distance between the work implement and the design terrain when the surface compaction determination condition is satisfied; and maintaining the surface compaction control when the leveling determination condition is satisfied while the surface compaction control is being executed.

15. A work vehicle comprising:

a work implement; and a controller including a memory and a processor, the controller being programmed to execute a leveling control in which work implement is controlled such that the work implement moves along a design terrain indicating a target shape of a work object when a leveling determination condition is satisfied, the leveling determination condition indicating that the work performed by the work implement is leveling work, execute a surface compaction control in which the work implement is controlled such that a velocity of the work implement toward the design terrain is limited in response to a distance between the work implement and the design terrain when a surface compaction determination condition is satisfied, the surface compaction determination condition indicating that the work performed by the work implement is surface compaction work, and maintain the surface compaction control when the leveling determination condition is satisfied while the surface compaction control is being executed.

* * * * *